United States Patent [19]

Hosoi et al.

[11] Patent Number: 4,838,200

[45] Date of Patent: Jun. 13, 1989

[54] DEVELOPING APPARATUS

[75] Inventors: Atsushi Hosoi, Tokyo; Hatsuo Tajima, Matsudo, both of Japan

[73] Assignee: Canon Kabushiki Kaisha, Tokyo, Japan

[21] Appl. No.: 911,765

[22] Filed: Sep. 26, 1986

[30] Foreign Application Priority Data

Sep. 30, 1985 [JP] Japan ..... 60-217557

[51] Int. Cl.[4] ..... G03G 15/09

[52] U.S. Cl. ..... 118/658; 355/215; 355/251

[58] Field of Search ..... 118/657, 658; 355/3 DD

[56] References Cited

U.S. PATENT DOCUMENTS

| | | | |
|---|---|---|---|
| 4,244,322 | 1/1981 | Nomura et al. | 118/658 |
| 4,334,772 | 6/1982 | Suzuki | 353/3 DD |
| 4,386,577 | 6/1983 | Hosono et al. | 118/657 |
| 4,387,664 | 6/1983 | Hosono et al. | 118/658 |
| 4,548,489 | 10/1985 | Yoshikawa | 355/3 DD |
| 4,563,978 | 1/1986 | Nakamura et al. | 118/658 |
| 4,579,082 | 4/1986 | Murasawa et al. | 118/658 |
| 4,615,608 | 10/1986 | Mizutani | 118/658 |
| 4,660,958 | 4/1987 | Egami et al. | 355/3 DD |

FOREIGN PATENT DOCUMENTS

| | | | |
|---|---|---|---|
| 0231568 | 12/1984 | Japan | 355/3 DD |
| 0134263 | 7/1985 | Japan | 355/3 DD |
| 0159770 | 8/1985 | Japan | 355/3 DD |
| 0159773 | 8/1985 | Japan | 355/3 DD |

*Primary Examiner*—Shrive Beck
*Assistant Examiner*—Alain Bashore
*Attorney, Agent, or Firm*—Fitzpatrick, Cella, Harper & Scinto

[57] ABSTRACT

A developing apparatus for developing a latent image using a developer containing carrier particles and toner particles in a developing position, includes a developer, container, a developer carrying member magnetic field generating pole, disposed across the developer carrying member from its developer carrying surface a regulator for regulating an amount of the toner particles and carrier particles to be applied on the surface of the developer carrying member; a magnetic member disposed upstream of the regulator and the downstream of the developing position and having a surface spaced from the surface of the developer carrying member to form a clearance which decreases toward a downstream side and being from an upstream side effective to enhance the magnetic field formed between the magnetic field generating pole and the magnetic member such that the enhanced magnetic field allows the developer to return to the container after passing through the developing position to enter the developer container while preventing the magnetic particles in the container from leaking out of the container.

29 Claims, 5 Drawing Sheets

DEVELOPING APPARATUS

FIELD OF THE INVENTION AND RELATED ART

The present invention relates to a developing apparatus wherein two component developer, more particularly, two component developer which contains magnetic carrier particles and toner particles.

In U.S. Pat. Nos. 4,386,577 and 4,387,664 which have been assigned to the assignee of the present application, it has been proposed that a thin layer of a developer is formed on a developer carrying member and is closely opposed to a latent image, where an alternating electric field is formed, whereby the latent image is developed.

The proposed developing apparatus is advantageous in that the development efficiency (which is a rate of the toner consumable for the development to the toner present at the developing position, is high so that the size of the developing apparatus can be reduced. Since, however, the developer used with this apparatus is one component magnetic toner, the toner has to contain magnetic material, and therefore, there is a difficulty in fixing the developed image, and the reproduction of a color image is not satisfactory.

In order to solve this problem, another proposal has been made in U.S. Pat. Nos. 4,548,489 and 4,579,082 which have been assigned to the assignee of the present application. In this proposed apparatus, a non-magnetic toner is used, and a thin layer of the non-magnetic toner is formed on a developer carrying member wherein the thin layer contains only the non-magnetic toner. The thin layer of the non-magnetic toner is opposed to the latent image under the existence of an alternating electric field, whereby the latent image is developed. This is advantageous in that the problem caused by the magnetic material contained in the toner is not involved without losing the advantage of the above developing apparatus using the non-magnetic toner. However, there are disadvantages that the image density of the developed image is relatively low and that it can exhibit a negative development property, wherein the image density of the developed image decreases with increase of the potential of the latent image.

In the developing apparatus which contains a mixture of the magnetic particles and toner particles only in the developer container, there is a further problem that the magnetic particles can leak out of the developer container. This problem has been solved by the proposal made in U.S. Pat. No. 4,563,978 and U.S. Ser. No. 759,110 now U.S. Pat. No. 4,638,760 which is a continuation-in-part application therefrom, which have been assigned to the assignee of the present application.

It is a premise that the magnetic particles are not supplied to the developing position. However, it is possible that the magnetic particles go out of the container to reach the developing position. The above patent and application disclose a combination of a magnetic pole and a magnetic member which constitutes a magnetic seal and is effective to collect and the recover the unintensionally discharged magnetic particles. This is important since the sealing effect is remarkable. The magnetic seal has been found to be effective to allow the magnetic particles to enter the developer container while preventing the toner particles from leaking out of the container. However, after a long period of use, or in the case that the developing apparatus is detachably mountable into an image forming apparatus wherein it can be impacted for some reason, a slight amount of the toner can leak out, or the magnetic particles may not enter back. This has been found by the inventors of the present application. It is added, however, that such inconveniences are still much less significant as compared with the toner particle scattering which results when the magnetic seal is not employed and.

SUMMARY OF THE INVENTION

As a result of various experiments and considerations, the inventors have produced a developing apparatus using the two component developer wherein the magnetic carrier particles in addition to the toner particles are positively supplied to the developing position, and wherein the above-described problems have been solved.

It is a principal object of the present invention to provide a developing apparatus wherein the leakage of the toner particles from the developer container is effectively prevented, while allowing the magnetic particles returns thereinto, whereby the developing operation performance is maintained stably high.

It is another object of the present invention to provide a developing apparatus wherein both of the toner particles retained on the surfaces of the magnetic particles and the toner particles retained on the surface of the developer carrying member are used for the developing operation, as contrasted to the conventional developing apparatus using two component developer, and wherein the magnetic particles and the toner particles are returned into the developer container with certainty by using magnetic sealing means.

It is a further object of the present invention to provide a magnetic sealing mean usable with the conventional developing apparatus using the two component developer and supplying a large amount of the magnetic particles to the developing position, whereby the magnetic particles are not lost so that the stabilized developing operation can be maintained.

It is a further object of the present invention to provide structural conditions, under which the developing operation is improved when use is made of a thin layer of developer particles on the developer carrying member.

According to an embodiment of the present invention, there is provided a developing apparatus for developing a latent image using a developer containing carrier particles and toner particles in a developing position, comprising a container for containing the developer which contains toner particles and magnetic particles; a developer carrying member, opposed to a latent image bearing member, for forming the developing position for supplying the toner particles to the latent image bearing member and for carrying the developer from said container to the developing position; magnetic field generating means, disposed across said developer carrying member from its developer carrying surface, for generating a magnetic field; means for regulating an amount of the toner particles and carrier particles to be applied on the surface of said developer carrying member; a magnetic member disposed upstream of said regulating means and downstream of the developing position with respect to movement of said developer carrying member, said magnetic member having a surface spaced from the surface of said developer carrying member to form a clearance which decreases toward a downstream side from an upstream side, wherein a minimum of the clearance occurs downstream of a center of said magnetic field generating means with respect to movement of said developer carrying member; wherein said magnetic member is effective to enhance the magnetic field formed between said magnetic field generating means and said magnetic member, and the enhanced magnetic field allows the developer to return to said container after passing through the developing position to enter said developer container while preventing the magnetic particles in said container from leaking out of said container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
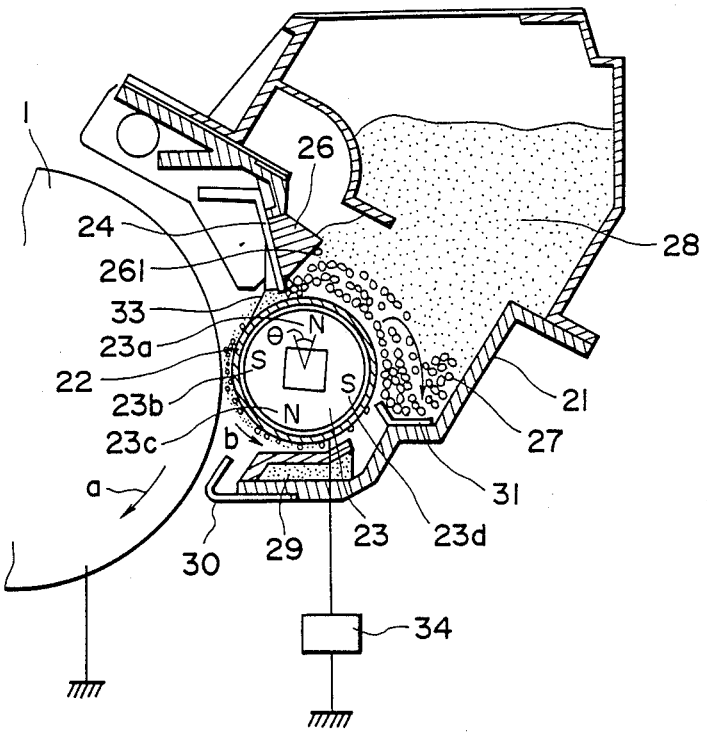
FIG. 1 is a sectional view of a developing apparatus according to an embodiment of the present invention.

Referring to FIG. 1, there is shown a developing apparatus according to an embodiment of the present invention, wherein an electrostatic latent image bearing member for bearing the electrostatic latent image to be developed is indicated by a reference numeral 1. The image bearing member 1 is in this embodiment a photosensitive drum, but may be a photosensitive or dielectric drum or belt movable along an endless path. The process of forming an electrostatic latent image on the image bearing member is not the feature of the present invention, and any suitable electrostatic latent image formation process is usable. In this embodiment, the image bearing member is a photosensitive drum on which an electrostatic latent image is formed by an electrophotographic process. The photosensitive drum 1 is rotatable in the direction indicated by an arrow a.

The developing apparatus according to this embodiment comprises a developer container 21, a developing sleeve 22 (hereinafter will be called simply "sleeve") as the developer carrying member, a magnet 23 as the magnetic field generating means, a regulating blade 24 (hereinafter will also be called simply "blade") for regulating the amount of the developer conveyed to the developing position on the sleeve 22, a magnetic member 31 and an electric power source 34 as the alternating electric field generating means. The structures of the respective elements will be described.

The container 21 contains the developer containing the magnetic particles 27 and the toner particles 28 mixed together. The toner particle in this embodiment is a non-magnetic toner particle having a particle size of 7–20 microns, mainly consisting of 10 parts of carbon and 90 parts of polystyrene, for example. The toner particles and the magnetic particles are accommodated in this embodiment such that the magnetic particle content is high in the neighborhood of the sleeve 22 surface but it is low away from the sleeve 22 surface. However, they may be distributed uniformly in the container 21. The container 21 has an opening at a left bottom position, as seen in FIG. 1.

The sleeve 22 is made of a non-magnetic material such as aluminum and is disposed in the opening of the container 21 with a part of its surface exposed and the rest of the surface within the container 21. The sleeve 22 is rotatably supported along an axis perpendicular to the sheet of the drawing of FIG. 1 and is rotated in operation in the direction of an arrow b. In this embodiment, the sleeve 22 is illustrated as being a cylindrical sleeve, but it may be an endless belt.

The sleeve 22 is opposed to the photosensitive drum 1 with a small clearance to constitute a developing position or zone, to which the toner and magnetic particles are carried on the sleeve 22 so that the volumetric ratio of the magnetic particles therein is 1.5–30%. This will be described in detail hereinafter.

The magnet 23 is disposed in the sleeve 22. The magnet 23 is fixed so that it does not rotate when the sleeve 22 rotates. The magnet 23 has a magnetic pole 23*a* (N) cooperative with the blade 24 which will be described hereinafter to regulate the amount of the developer to be applied on the sleeve 22 as a developer layer, a developing pole 23*b* (S), magnetic poles 23*c* (N) and 23*d* (S) for collecting the developer after passing through the developing position back into the container 21. The polarities of the magnetic poles may be reversed. The magnet 23 is a parmanent magnet in this embodiment, but it may be an electromagnet.

The magnetic member 31 is disposed in association with the magnetic pole 23*d*, and will be described in detail hereinafter.

The blade 24 in this embodiment is made of a non-magnetic material such as aluminum at least at its free end portion. The blade 24 extends along the length of the sleeve 22 in the neighborhood of the upper portion of the opening of the container 21. The base portion of the blade 24 is fixed to the container 21. The free end of the blade 24 is opposed to the surface of the sleeve 22 with a clearance, which is 50–500 microns, preferably 100–350 microns. In this embodiment, the clearance is 250 microns. If the clearance is less than 50 microns, the clearance is easily clogged by the magnetic particles, whereas if it is larger than 500 microns, too large an amount of the magnetic particles and toner particles are passed through the clearance with the result that the suitable thickness of the developer layer can not be formed on the sleeve 22. The thickness of the layer is less than the clearance between the surface of the photosensitive drum 1 and the surface of the sleeve 22 at the developing position on the assumption that the magnetic force does not exist. In order to form the developer layer of this thickness, it is preferable that the clearance between the edge of the blade 24 and the surface of the sleeve 22 is equivalent or smaller than the clearance between the surface of the photosensitive drum 1 and the surface of the sleeve 22. However, it is possible to form such a layer with a larger clearance between the blade 24 and the sleeve 22. At the inside wall of the blade 24, there is provided a member 26 effective to limit the circulating movement of the magnetic particles. The member 26 serves to limit the region of circulation of the magnetic particles within the container 21. The circulation will be described hereinafter.

The power source 34 applies a voltage between the photosensitive drum 1 and the sleeve 22 to form an alternating electric field across the clearance therebetween, by which the toner particles transfer onto the photosensitive drum 1 from the developer layer on the sleeve 22. The alternating voltage provided by the power source 34 may be symmetrical, that is, the peak voltages at the positive side and the negative side are equal, or may be an asymmetrical voltage which may be provided by superimposing a DC voltage to the symmetrical voltage. As an example, when the electrostatic latent image having a dark portion potential of −600 V and a light portion potential −200 V is to be developed, the sleeve 22 is supplied with the asymmetrical voltage of 200–3000 Hz having a peak-to-peak voltage of 300–2000 Vpp provided by a superimposed DC voltage of −300 V, while the photosensitive drum 1 is grounded.

The bottom portion of the container 21 extends toward the photosensitive drum 1 to form an extension to prevent the developer, particularly the toner particles, from scattering or leaking to the outside. In order to assure such prevention, a member 29 is fixed to the top surface of the extension in this embodiment so as to receive and confine the developer particles. To the edge of the extension, a member 30 is fixed so as to extend along the length of the sleeve 22 to prevent the particles from scattering, as shown in FIG. 1. To the member 30, a voltage having the same polarity as the toner particles may be applied, whereby the toner scattered from the developing position is urged toward the photosensitive drum 1 b the electric field formed thereby, so as to prevent the toner scattering.

Adjacent the opposite ends of the sleeve 22, there is provided a developer limiting member 25, which functions to prevent the application of the developer on the sleeve 22 surface adjacent the longitudinal end portions of the sleeve.

The operation of the developing apparatus according to this embodiment will be described. First, the magnetic particles 27 are supplied into the container 21. Those magnetic particles are attracted and maintained on the sleeve 22 surface by the magnetic force provided by the magnetic poles 23*a* and 23*d* to cover the entire surface of the sleeve 22 within the container 21, thus forming a layer of magnetic particles. Those portions of the magnetic particle layer which are close to the magnetic poles 23*a* and 23*d* are formed into a magnetic brush. Subsequently, the toner particles 28 are supplied into the container 21, thus forming a toner layer outside the magnetic particle layer. It is preferable that the magnetic powder first supplied into the container 21 contains 2–70% by weight of the toner, but the powder may consist only of magnetic particles. After the magnetic particles 27 are once attracted to the surface of the sleeve 22 as the magnetic particle layer, they do not significantly flow or incline even when the developing apparatus vibrates or becomes fairly inclined, and keep covering the surface of the sleeve 22

When the sleeve 22 rotates in the direction indicated by an arrow, the magnetic particles move upwardly in the direction along the surface of the sleeve 22 from the bottom portion of the container 21 to reach the neighborhood of the blade 24, where a part of the magnetic particles passes through the clearance between the sleeve 22 and the edge of the blade 24 together with the toner particles. The rest of the magnetic particles impinge on the member 26, and thereafter, are turned downwardly and are lowered by gravity to the bottom portion of the container 21. They again rise due to the rotation of the sleeve 22 adjacent thereto. This is repeated to form a circulation of the magnetic particles. Among the magnetic particles 27 rising toward the blade 24 from the bottom portion of the container 21, there are particles which turn downwardly prior to reaching the neighborhood of the blade 24. The magnetic particles relatively away from the surface of the sleeve 22 tend to make this movement.

The magnetic powder turned in the neighborhood of or before the blade 24 takes thereinto the toner particles from the outside toner layer. During the circulation with the rotation of the sleeve 22, the toner particles 28 are triboelectrically charged by the friction with the magnetic particles 27 and the sleeve 22 surface.

Adjacent the position before the blade 24, the magnetic particles 27 near the surface of the sleeve 22 are attracted to the sleeve surface by the magnetic force of the magnetic pole 23*a*, and therefore, the pass under the blade 24 to go out of the container 21 with the rotation of the sleeve 22. During this movement, the magnetic particles 27 carry the toner particles deposited on their surfaces out of the container 21. Additionally, some of the charged toner particles 28 are attracted onto the sleeve surface by image force and are also carried out of the container 21 on the sleeve 22. The blade 24 is effective to those developer applied on the sleeve 22 surface.

The layer of the developer (the mixture of the magnetic particles 27 and the toner particles 28) formed on the sleeve surface 22 is carried on the surface of the sleeve 22 to reach the developing position or zone where the sleeve 22, and therefore, the layer is opposed to the surface of the photosensitive drum 1. In the developing position, the toner particles are transferred onto the latent image on the photosensitive drum 1 both from the surfaces of the magnetic particles and from the surface of the sleeve 22 by the alternating electric field formed across the clearance between the photosensitive drum 1 and the sleeve 22, whereby the latent image is developed. The volumetric ratio of the magnetic particles in the developing position is preferably 1.5–30%, which will be described in detail hereinafter.

With the continued rotation of the sleeve 22, the toner particles and magnetic particles not having been consumed for the development are collected back into the container 21. They are mixed with the particles in the container 21 by the above described circulation and are again supplied on the sleeve 22. During this circulation, the magnetic powder takes thereinto the toner particles from the upper toner layer in the container 21, whereby it is resupplied with toner in the amount which has been consumed.

Figure 2:
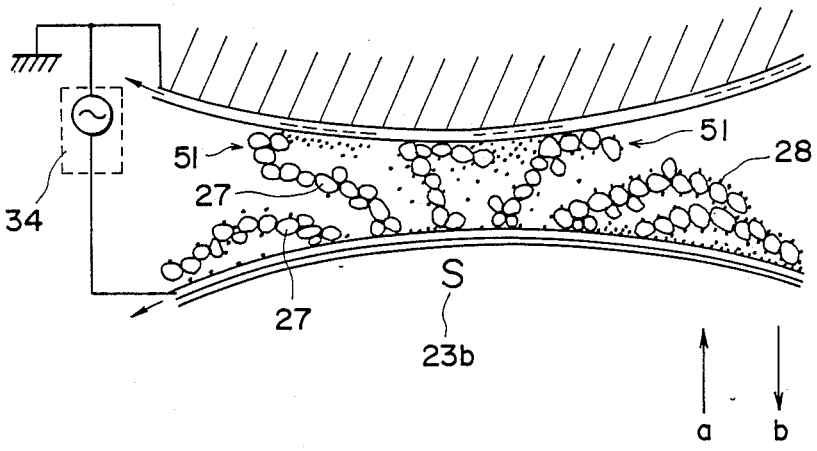
FIG. 2 is an enlarged sectional view of developing position of the developing apparatus shown in FIG. 1.

FIG. 2 is an enlarged sectional view of the developing position illustrating the developing action. The photosensitive drum 1 retains the electric charge constituting the latent image. In this embodiment, the electric charge constituting the latent image is negative, and therefore, the toner particles are charged positive. In FIG. 2, the photosensitive drum 1 and the sleeve 22 rotate such that the peripheral movements thereof are co-directional, as indicated by the arrows. Across the clearance formed therebetween, the above described alternating voltage is applied from the power source 34. At a position corresponding to a position where the photosensitive drum 1 and the sleeve 22 are closest, the magnetic pole 23*b* of the magnet 23 is disposed within the sleeve 22.

In the space between the photosensitive drum 1 and the sleeve 22, there is the developer which is the mixture of the magnetic particles 27 and the toner particles carried on the rotating sleeve 22. It should be noted that the developing system according to this embodiment is essentially different from those disclosed in the above mentioned U.S. Pat. Nos. 4,548,489, 4,579,082 and 4,563,978 in the existence of the magnetic particles in the developing position. Because of the volumetric ratio which will be described hereinafter, of the magnetic particles in the developing position, the amount of the magnetic particles present in this position is far less than in the usual so-called magnetic brush developing system, and in this point, the developing system according to this embodiment is essentially different from those magnetic brush developing systems. The very small amount of the magnetic particles 27 form sparse chains 51 of the magnetic particles by the magnetic pole 23*b*. Due to the larger movability of the magnetic particles 23 provided by the sparseness, the action of the magnetic particles 27 is peculiar.

More particularly, the sparse chains of the magnetic particles are distributed uniformly in the direction of the magnetic lines of force, and simultaneously, the surface of the sleeve 21 as well as the surfaces of the magnetic particles are opened. Therefore, the toner particles on the magnetic particle surfaces can be supplied to the photosensitive drum without obstruction by the chains, and simultaneously, the uniformly distributed opened portions of the sleeve surface can be established, whereby the toner particles can be transferred from the sleeve surface to the photosensitive surface by the alternating electric field.

The description will be made as to the behavior of the magnetic particles and the toner particles. As shown in FIG. 2, the electrostatic latent image in this example is formed by the negative charge (dark portion of the image), so that the electric field by the electrostatic latent image is directed as indicated by an arrow a in FIG. 2. The direction of the electric field provided by the alternating electric field alternates.

In the phase wherein the positive voltage is applied to the sleeve 22, the electric field is codirectional with the electric field of the latent image. At this time, the amount of the electric charge injected into the chains 51 is maximum, and therefore, the chains 51 stand up most, and long chains reach to the surface of the photosensitive drum 1. On the other hand, the toner particles 28 on the sleeve surface and the magnetic particle surfaces are charged in the positive polarity as described hereinbefore, and therefore, they are transferred to the photosensitive drum 1 by the electric field formed in this space. It should be noted here that the erected chains 51 are sparsely distributed, so that the surface of the sleeve 22 is exposed or opened, whereby the toner particles are released both from the surface of the sleeve 22 and the surfaces of the chains 51. Additionally, there is the electric charge having the polarity opposite to that of the toner particles 28 in the chains 51, and therefore, the toner particles 28 on the surfaces of the chains 51 are easy released by the electrostatic repelling force.

During the phase wherein the negative voltage is applied to the sleeve 22, the electric field by the alternating voltage (arrow b) and the electric field by the electrostatic latent image (arrow a) are counterdirectional. Therefore, the electric field in this space is strong in the opposite direction, so that the amount of charge injection is relatively small. Consequently, the chains 51 are collapsed in accordance with the amount of the charge, and they establish a collapsed contact state.

Since the toner particles 28 on the photosensitive drum 1 are charged positive as described hereinbefore, the toner particles 28 transfer back to the sleeve 22 and back to the magnetic particles 27 from the photosensitive drum 1 by the electric field formed across the space. In this manner, the toner particles 28 reciprocate between the photosensitive drum 1 and the sleeve 22 surface and between the photosensitive drum 1 and the magnetic particle surfaces. With the increase of the clearance therebetween caused by the rotation of the photosensitive drum and the sleeve 22, the electric field is weakened, and the developing operation terminates.

At the chains 51, there are triboelectric charges caused by the friction with the toner particles 28 or image charge and the charge injected by the electrostatic latent image charge on the photosensitive drum 1 and the alternating electric field between the photosensitive drum 1 and the sleeve 22. The state of those electric charges depends on the time constant of the charging and the discharging determined by the material of the magnetic particles 27 and other parameters.

In this manner, the chains 51 of the magnetic particles 27 produce fine but violent vibrating movement.

Now, the description will be mad with respect to the volumetric ratio of the magnetic particles at the developing station. The "developing position" or "developing zone" is defined as the region in which the toner particles are transferred or supplied from the sleeve 22 to the photosensitive drum 1. The "volumetric ratio" is the percentage of the volume occupied by the magnetic particles present in the developing position or zone to the entire volume of the developing position or zone. The volumetric ratio is significantly influential in this developing apparatus, more particularly, it is preferable that the volumetric ratio is 1.5–30%, more preferably 2.6–26%.

If this is smaller than 1.5%, the problems have been confirmed that the image density of the developed image is too low; that a ghost image appears in the developed image; a remarkable density difference occurs between the position where the chain 51 exists and the position where no chain exists; and or that the thickness of the developer layer formed on the sleeve 22 is not uniform.

If the volumetric ratio is larger than 30%, the surface of the sleeve is closed, that is, covered by the magnetic particles too much, and a foggy background results.

It should be appreciated that the present invention is based on the finding by the inventors that the image quality does not monotonously become better or worse with the increase or decrease of the volumetric ratio; that satisfactory image density can be obtained within the range of 1.5–30% of the volumetric ratio; the deterioration of the image is recognized both below 1.5% and beyond 30% of the volumetric ratio; and that in this satisfactory range, neither ghost image nor foggy background results. The image deterioration resulting when the volumetric ratio is low is considered to be caused by the negative property, while the deterioration when the volumetric ratio is too large is considered to be caused by the closed or covered sleeve surface resulting from the large amount of the magnetic particles, thus reducing too much the toner supply from the sleeve surface.

If the volumetric ratio is less than 1.5%, the image reproducibility of a line image is not satisfactory with a remarkable decrease of the image density. If it is more than 30%, the magnetic particles can physically damage the surface of the photosensitive drum 1, and the toner particles can be kept deposited on the photosensitive drum as a part of the developed image, which is a problem at the subsequent image transfer or image fixing station.

In the region where the volumetric ratio is near 1.5%, a locally non-uniform development can occur (under particular conditions) when a large area solid black image is developed. For this reason, the volumetric ratio is determined such that this does not occur. For this purpose, it is more preferable that the volumetric ratio is not less than 2.6%, and therefore, this defines a further preferable range.

If the volumetric ratio is near 30%, the toner supply from the sleeve surface can be delayed in such a region adjacent the positions where the chains of the magnetic particles are contacted, for example, when the developing speed is high. If this occurs, a non-uniform developed image can result in the form of scales in the case of solid black image reproduction. In order to assure the prevention of this, the volumetric ratio is preferably not more than 26%.

Where the volumetric ratio is in the range of 1.5–30%, the chains 51 of the magnetic particles are formed on the sleeve surface and are distributed sparsely to a satisfactory extent, so that the toner particles on the chain surfaces and those on the sleeve surfaces are sufficiently opened toward the photosensitive drum 1, and the toner particles on the sleeve 22 are transferred by the alternating electric field. Thus, almost all of the toner particles are consumable for the purpose of development. Accordingly the development efficiency (the ratio of the toner consumable for the development to the overall toner present in the developing position), and also a high image density can be provided. Preferably, the fine but violent vibration of the chains is produced, by which the toner powder deposited on the magnetic particles and the sleeve surface are sufficiently loosened. In any case, the trace of brushing or occurrence of the ghost image as in the magnetic brush development can be prevented. Additionally, the vibration of the chains enhances the frictional contact between the magnetic particles 27 and the toner particles 28, with the result of the increased triboelectric charging to the toner particles 28, by which the occurrence of the foggy background can be prevented. Also, the high development efficiency is suitable to the reduction of the size of the developing apparatus.

The volumetric ratio of the magnetic particles in the developing position is determined;

$$(M/h)\times(1/\rho)\times[C/(T+C)]$$

where

M is the weight of the developer (the mixture) per unit area of the sleeve surface when the erected chains are not formed ($g/cm^2$);

h is the height of the space of the developing position (cm); $\rho$ is the true density ($g/cm^3$);

$C/(T+C)$ is the percentage of the magnetic (carrier) particles in the developer on the sleeve.

The percentage of the toner particles to the magnetic particles at the developing position as defined above is preferably 4–40% by weight.

In this embodiment, the alternating electric field is strong enough (large rate of change or large Vpp), the chains 51 are released from the sleeve 22 surface or from their base portions, and the released magnetic particles 27 also reciprocate between the sleeve 22 and the photosensitive drum 1. Since the energy of the reciprocal movement of the magnetic particles is large, the above described effect of the vibration are further enhanced.

The above described behavior has been confirmed by a high speed camera available from Hitachi Seisakusho, Japan operable at the speed of 8000 frames/sec.

Even in the case where the clearance is reduced between the photosensitive drum 1 surface and the sleeve 22 surface so as to increase the contact pressure between the photosensitive drum 1 and the magnetic particle chains 51 and to decrease the vibration, the clearance is still large enough at the inlet and outlet sides of the developing position, and therefore, the vibration is sufficient with the above described advantages.

On the contrary, if the clearance is increased it is preferable that the magnetic particle chains 51 are contacted to the drum 1 surface when the electric field is applied, even if they do not contact the drum surface without the electric field.

When the magnetic particles having a relatively low resistance are used, the alternating voltage applied between the photosensitive drum 1 and the sleeve 22 is selected such that at the peaks thereof, the electric discharge does not occur therebetween at the dark portions or light portions of the latent image. When the chains of the magnetic particles having a relatively high resistance are used, the voltage is preferably selected such that the voltage across the clearance reaches a discharge on-set voltage by suitably selecting the frequency of the alternating voltage and selecting the charge and discharge time constant of the chains of the magnetic particles.

With those taken into account, the resistance of the entire chain in the direction of the height thereof measured with the chain being contacted to the photosensitive drum 1, is preferably $10^{15}$–$10^{6}$ ohm-cm. When the developing electrode effect of the chain 51 is expected, it is preferably $10^{12}$–$10^{6}$ ohm.cm, and more preferably $10^{10}$–$10^{6}$ ohm.cm.

The average particle size of the magnetic particles 27 is 30–100 microns, preferably 40–80 microns. In general, with a decrease of the average particle size, the triboelectric charging property with the sleeve is improved, so that a so-called sleeve ghost (the image density decreases in the image which is developed immediately after a solid black image is developed, or the image density decreases gradually with the integrated number of rotations of the sleeve) does not result. However, when the particle size is small, there is a tendency that the magnetic particles are deposited onto the latent image bearing member. The positions where the magnetic particles are deposited, are different depending on the resistance of the magnetic particles. For example, relatively low resistance magnetic particles are deposited on the image area of the latent image, while high resistance particles are deposited in the non-image area. This is a general tendency, and actually the influence is recognized more or less by the magnetic properties of the magnetic particles, the surface configuration and the surface treating material (including resin coating).

In the developing apparatus used with commercial electrophotographic machines, wherein the magnetic field on the sleeve in the developing position is approximately 600–900 Gausses, it has been found that the magnetic particles are increasingly deposited when the size thereof is not more than 30 microns. On the contrary, if it is not less than 100 microns, the sleeve ghost is remarkable. Therefore, the range of 30–100 microns is preferable. In the developing apparatus according to this embodiment, relatively high resistance carrier particles having particle size of 50–100 microns for a two component developer, are usable.

The magnetic particles contain only magnetic material or may contain magnetic material and non-magnetic material. In addition, the magnetic particles may contain a mixture of two or more magnetic materials.

Next, the description will be made with respect to a so-called V-D curve, that is, the relation of the developed image density with respect to the surface potential of the latent image in the developing apparatus according to this embodiment.

Figure 3:
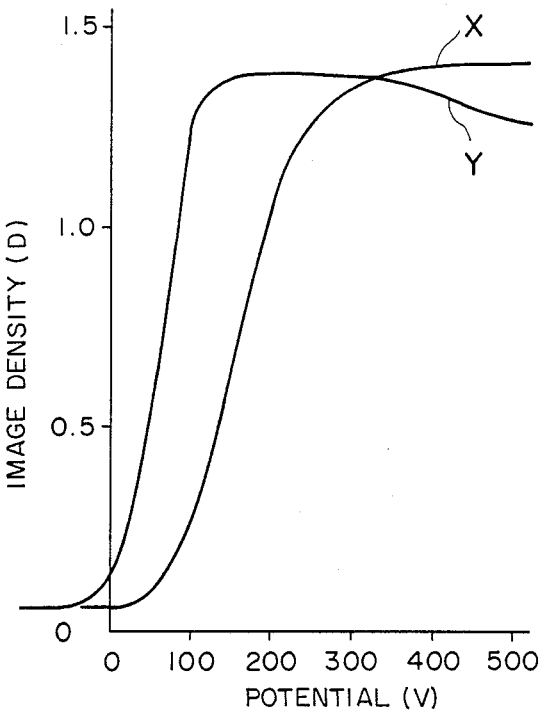
FIG. 3 is a graph showing the developing property of the developing apparatus according to the embodiment of the present invention.

FIG. 3 is a V-D curve graph, wherein the V-D curve in this apparatus is indicated by a reference X, and wherein the reflection density of the developed image measured by a Macbeth density meter is plotted against the potential difference between the photosensitive drum potential and the sleeve surface potential when the sleeve surface potential is assumed to be zero. It is understood that the V-D curve is excellent since it indicates that the background fog does not result at the low potential region, and the appropriate inclination is provided in the intermediate potential region, and still sufficient image density can be provided at the high potential region. As an example of a V-D curve of a developing apparatus not using the present invention, that of the developing apparatus disclosed in U.S. Pat. Nos. 4,548,489, 4,579,082 and 4,563,978 wherein a one component non-magnetic developer layer is opposed to a latent image under the existence of an alternating electric field, the developer layer being thin on the sleeve surface, is given in FIG. 3 and is indicated by a reference Y. As will be understood, the negative developing property appears, that is, in a range beyond a certain potential, the image density decreases with increase of the potential. This provides a tendency that the image density is not sufficient in a high potential region. As contrasted to this V-D curve, the property of the present invention is much better, since the foggy background is not produced in the low potential region; since the inclination is relatively less steep in the intermediate region, and therefore, the edge effect is not extreme; since the negative property does not appear in the intermediate potential region; and since sufficient image density can be obtained in the high potential region.

Then, the conditions will be discussed to form preferable chains of the magnetic particles.

Figure 4:
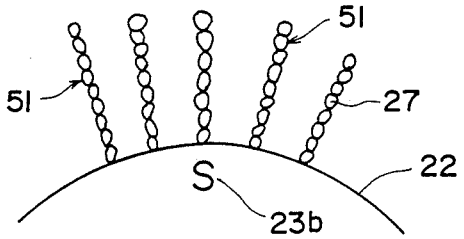
FIG. 4 is a sectional view illustrating formation of magnetic particle chains which is preferable in the developing apparatus according to the present invention.

FIG. 4 illustrates the chains which are preferable in the developing position, wherein the chains are formed independently from each other and wherein the chains are distributed uniformly over the sleeve 22 surface.

Figure 5:
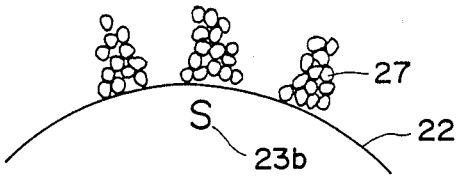
FIG. 5 is a sectional view of an unpreferable formation of the magnetic particle chains.

FIG. 5 illustrates chains which are not preferable, wherein the magnetic particles 27 are in the form of masses. It has been found that if the development is effected with such masses of magnetic particles, non-uniform patterns in the form of scales have appeared in an image, and therefore, this is not preferable.

The production of the mass of the magnetic particles is influenced by the material of the blade 24 and by an angle between the edge of the blade and the magnetic pole 23*a* seen from the center of the sleeve 22.

As for the material of the blade 24, non-magnetic material is preferable. When magnetic material is used, the magnetic lines of force are concentrated on the blade 24, with the result that the magnetic force for confining the magnetic particles is strong. In order for the magnetic particles to overcome the confining force and to g out of the container 21, a mass over a certain degree is required. Until such a mass is reached, they stay in the neighborhood of the blade 24 due to the strong magnetic confining force. Only when the mass reaches a sufficient level, the mass of the magnetic particles becomes able to advance out of the container 21. This is considered as being the reason why the magnetic particles are in the form shown in FIG. 5 when they reach the developing position on the sleeve 22.

Where the blade 24 is o non-magnetic material, the magnetic lines of force do not concentrate adjacent the edge of the blade 24, and therefore, the above-described mass is not produced, but the developer is applied uniformly over the sleeve. Consequently, uniform and sparse chains are formed in the developing position. For this reason, the blade 24 is preferably of a non-magnetic material. However, if the magnetic property is weak as when provided by bending a stainless steel (SUS304-JIS), such a magnetic material is usable.

As to the angle $\theta$, the blade 24 is disposed downstream of the magnetic pole 23*a*. If it is less than 2 degrees, the mass of the magnetic particles is produced, or the developer is not formed as a uniform layer on the sleeve 21. The reason for this is considered as follows. Since then, the magnetic particles are sparsely distributed along the magnetic lines of force adjacent the blade 24, and therefore, the magnetic particles are advanced only after a predetermined amount of the magnetic particles are stagnated here. On the other hand, if the angle $\theta$ is larger than 40 degrees, the effect of regulating the amount of the magnetic particles is extremely decreased. From this, it has been found that the angle $\theta$ is preferably not less than 2 degrees but not more than 40 degrees, further preferably, not less than 5 degrees but not more than 20 degrees.

The relationship between the angle $\theta$ and the amount of the developer passed under the blade edge is as follows. With the decrease of the angle $\theta$, the amount decreases, and therefore, the volumetric ratio at the developing station decreases. If the angle $\theta$ is increased, the opposite results. The amount of the toner particles applied on the surface of the sleeve 22 is substantially independent from the angle $\theta$, that is, it is substantially constant.

In this embodiment, the toner particles are retained on the magnetic particle 27 surfaces and the sleeve 22 surface. It is preferable that the ratio of those toner particles, more particularly, the ratio between the toner particles retained on the magnetic particles and the toner particles retained on the sleeve, is 1:2–10:1 by weight, more preferably, 1:1–5:1.

If the above ratio is less than 1:2, the V-D curve approaches the curve Y shown in FIG. 3, and therefore, is not preferable. If it is more than 10:1, on the contrary, the magnetic particles 27 are contacted to the surface of the photosensitive drum 1 too much with the result that the magnetic particles 27 are deposited on the photosensitive drum 1. This is not preferable, either. It has been confirmed that a good image results when the above ratio is within the range of 1:2–10:1.

This ratio can be controlled by changing the surface property of the sleeve 22, the triboelectric charging property of the toner particles and/or the property and the supply of the magnetic particles. Among those factors, the particle size of the magnetic particles and the amount of the magnetic particles supplied to the developing position are particularly influential.

With the increase of the particle size of the magnetic particles, the area of the surfaces capable of retaining the toner particles decrease (for the purpose of comparison, the total volume of the magnetic particles is supposed to be constant). Therefore, the amount of the toner retained on the magnetic particles, which is conveyed to the developing position, decreases. On the contrary, the amount of the toner particles retained on the sleeve 22 increases as if it compensates the reduction of the toner particles retained on the magnetic particles. If the particle size of the magnetic particles is reduced, the opposite tendencies result.

As for the amount of supply of the magnetic particles to the developing position, the amount of toner particles retained on the magnetic particles increases with increase of the supply of the magnetic particles. With this increase, the amount of toner retained on the sleeve 22 decreases slightly. If the supply of the magnetic particles is reduced, the tendencies ar opposite.

Therefore, by suitably selecting those factors, the above region of the ratio can be provided. However, if amount the magnetic particles is extremely increased, the amount of the magnetic particles which directly contact the photosensitive drum 1 is increased, and the magnetic particles 27 can be deposited on the surface of the photosensitive drum 1. If the size of the magnetic particles is extremely reduced, the magnetic confining force is decreased, so that the magnetic particles can be deposited on the photosensitive drum 1, that is, the latent image bearing member. The increase of the supply of the magnetic particles and reduction of the size of the magnetic particles whereby the toner particles which are not usable for the development are supplied, results in a decrease of the development efficiency.

The inventors have found that by suitably selecting the size and the amount of the magnetic particles 27, the above-described ratio can be made within a range of 1:1–5:1, wherein the satisfactory development can be achieved.

The ratio is measured in the following manner. First, all of the magnetic particles on the sleeve 22 is attracted from the sleeve 22 by a magnet. By doing so, the magnetic particles and the toner particles retained thereon are all collected to a magnet. The same is rinsed, and the amount of the toner which has been retained on the magnetic particles is measured in weight. Then, the toner particles remaining on the sleeve 22 is all sucked and collected by a filter. Again, it is rinsed, and the weight of the toner particles which have been retained on the sleeve is measured. As an alternative, the magnetic particles on the sleeve 22 is externally attracted by a magnet and rinsed, and thereafter, another developer layer is formed. Then, the developer layer (the magnetic particles, the toner particles retained on the magnetic particles and the toner particles retained on the sleeve) are all removed and rinsed to determine the total amount of the toner. Then, the amount of the toner particles on the sleeve 22 is obtained as a difference between the total amount of the toner and the amount of the toner retained on the magnetic particles. This alternative method is usable when the developing operation is sufficiently stabilized.

Now, the description will be made with respect to the magnetic sealing means constituted by the magnetic pole **23*d* and the magnetic member 31** in this embodiment.

Figure 7:
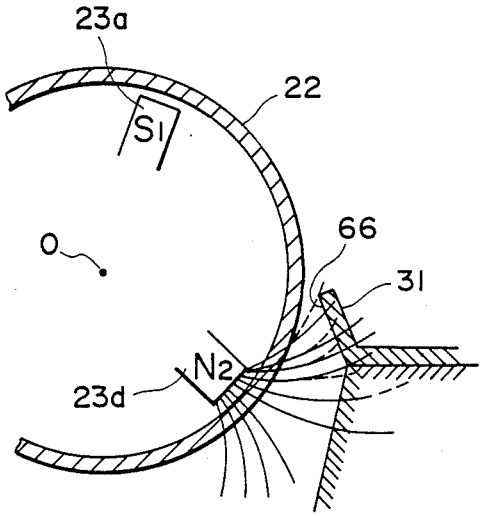
FIG. 7 shows a distribution of the magnetic lines of force in the structure shown in FIG. 6.
Figure 8:
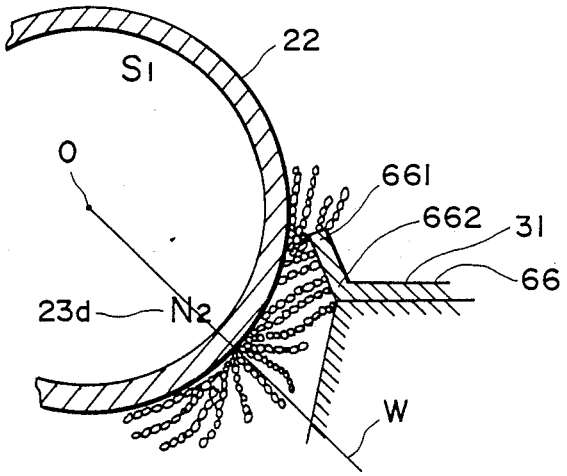
FIG. 8 shows the magnetic brush formed in the structure of FIG. 6.
Figure 9:
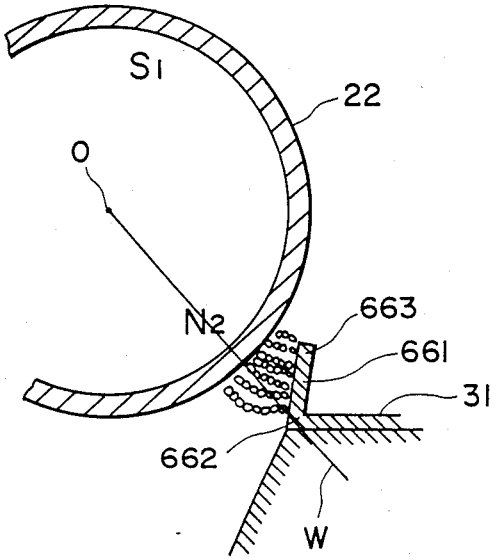
FIG. 9 is an enlarged sectional view of the portion of the magnetic material in the developing apparatus according to another embodiment of the present invention.

Referring to FIGS. 6, 7, 8, 9 and 10, the magnetic pole **23*a* (S1) produces a magnetic field in which the regulating blade 24 is disposed. A line connecting a point of maximum magnetic flux density on the surface of the sleeve by the magnetic pole 23*a* and a center O of the sleeve 22 is depicted by a reference W. The magnetic pole 23*d* is a magnetic sealing field generating means for producing a magnetic field between the magnetic member 31. In FIG. 9, the magnetic pole 23*d* is partly opposed to the magnetic member 31, while in FIGS. 6, 8 and 10, the magnetic pole 23*d* is not opposed to the magnetic member 31. In the Figures, the reference W is a line (plane) connecting the center O of the sleeve 22 and a point Y where the magnetic flux density on the sleeve 22 surface by the magnetic pole 23*d* (N2) is the maximum (normally, the center of the magnetic pole). The magnetic member 31** is disposed at a substantial end portion of the developer containing portion of the developer container at a lower part of the developer container, where the toner particles existing at the lower portion of the container are taken into the developer power adjacent the sleeve surface by the movement of the magnetic carrier particles returned thereinto. Thus, the stabilized returning of the magnetic particles can stabilize the developing performance.

Figure 6:
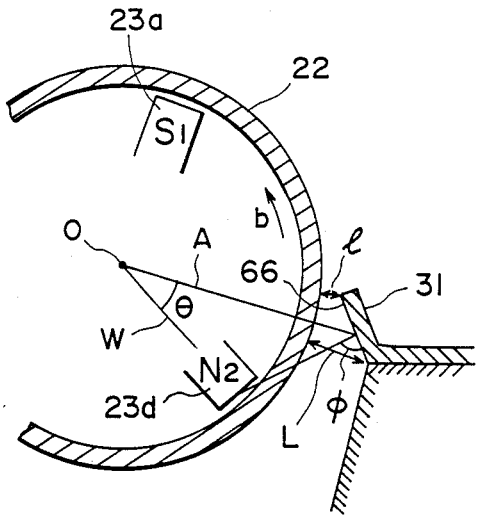
FIG. 6 is an enlarged sectional view of the portion of the magnetic member of the developing apparatus of FIG. 1.

FIG. 6 illustrates the angular relationship in an embodiment of the magnetic seal according to the present invention.

FIG. 7 illustrates the distribution of the magnetic field formed in the magnetic sealing system.

FIG. 8 illustrates the actual distribution of the magnetic particles in the arrangement of FIG. 7.

FIG. 9 illustrates the distribution of the magnetic particles provided by the magnetic field distribution which is another preferred embodiment.

The magnetic member 31 is shaped "L" and is slightly magnetized, for example, by deforming or bending an unmagnetized member such as a magnetizable member, e.g., iron not permanently magnetized. If a magnet is used as the magnetic member 31, the magnetic polarity at the surface 66 has to be opposite (S) to the polarity (N) of the magnet **23*d*** (N2).

A line A (plane) connecting the center of the magnet **23*d* (N2) which provides the maximum magnetic flux density on the sleeve surface and the middle position C (with respect to the direction b of the rotation of the sleeve 22) of the surface 66 of the magnetic member 31 extending toward the magnet N2, is considered. The surface 66 has a length extending the downstream side with respect to the direction b of the sleeve movement. The angle $\phi$ formed from the line A to the surface 66** toward the downstream side is preferably more than 90 degrees and less than 180 degrees. This is advantageous since then a relatively weak magnetic field concentration is formed adjacent the upstream side of the surface 66 with respect to the direction b, while a relatively strong magnetic field concentration is formed at the downstream side of the surface 66 with respect to the direction b. The distance between the surface of the sleeve 22 and the surface 66 is preferably such that the distance 1 at the downstream side of the surface 66 with respect to the direction b is less than the distance L at the upstream side thereof. This relationship between the distances is preferable from the standpoint of preventing the magnetic particles from leaking out of the developer container while allowing the magnetic particles to enter the developer container.

It is one of the important points in the magnetic member 31 that the concentration of the magnetic lines of force is stronger at the downstream side of the magnetic member 31 with respect to the direction b than at the upstream side with respect to the direction b. It is preferable that such a diverging magnetic field is formed, as illustrated in FIG. 7. This is effective to form the chains of magnetic particles in the form of a curtain of the magnetic particles as shown in FIG. 8. More particularly, the chains are relatively more concentrated, and the number of chains is relatively larger at the downstream side than the upstream side. By this structure, the following process is accomplished. At the downstream region 661 of the magnetic member 31, the developer particles are prevented from discharging out of the developer container, while at the upstream region 662, the magnetic particles carried on the sleeve 22 is allowed to enter the developer container, and simultaneously therewith, the magnetic particles received in the upstream side 662 are confined. Thus, the magnetic member 31 prevents the loss of magnetic particles. The magnetic particles overcome the downstream sealing effect by the magnetic member 31 and are received into the developer container by the continuing conveying force of the sleeve and the pushing force applied by the magnetic particles continuously coming thereto.

As will be understood, the magnetic member 31 in cooperation with the magnetic pole is effective to confine the magnetic particles and to prevent the loss of the magnetic particles and to make it easy for the magnetic particles to return, whereby the toner particles in the developer container are effectively prevented from leaking out of the container.

In FIGS. 7 and 8, the edge of the magnetic member 31 constitutes a limiting portion where the magnetic particles are greatly concentrated. However, the limiting portion may be located in the middle or upstream position of the magnetic member 31 with respect to the direction b. It is preferable, however, that at the upstream side of the limiting portion, a weaker concentrated magnetic field is formed than the limiting portion.

FIG. 9 illustrates an example of this case and shows that the present invention does not rely on the position of the magnet adjacent the magnetic member 31 to form the effective magnetic seal. Nonetheless, in order to establish the desirable diverging magnetic field and to accomplish the desirable seal, it is preferable that the magnetic member 31 is disposed at the downstream side of the associated magnet with respect to the movement of the sleeve 22.

In the FIG. 9 arrangement, the relatively weak magnetic field concentration portion 663 (edge portion) is formed at a position more downstream side than in the FIG. 8 embodiment.

The edge portion 663 is effective to confine the magnetic particles and is effective to make it easier for the magnetic particles the return from the upstream side 662 through the downstream portion 661 into the developer container, wherein the power of combining the magnetic particles is increased so that the leakage of the toner can be further prevented. In FIG. 9, the above described conditions that the angle $\phi$ is larger than 90 degrees and less than 180 degrees, and that the distance L is larger than the distance 1 are satisfied. Thus better sealing effect as a whole can be accomplished.

Even if the positional relation is the same, the state of the diverging magnetic field is different depending on the degree of magnetization of the magnetic member 31 and the distribution of the magnetic field by the magnet. The present invention covers the case where the above described state of distribution is provided.

The length of the surface 66 of the magnetic member 31, measured along the circumference of the sleeve 22 is preferably not less than 1.5 mm, more preferably, not less than 2.0 mm. The further preferable condition is that it is not more than 6 mm, and practically, not more than 5 mm. By this, the concentrating magnetic field is formed which can satisfy the diverging state of the magnetic field and which is effective to prevent the leakage of the magnetic particles.

Further, by locating the magnetic pole **23*d* in the manner described above, another advantage can be provided in connection with the magnetic pole 23*a*. More particularly, the above-described relationship between the magnetic pole 23*d* and the developer containing portion at the bottom of the container 21, the magnetic brush in the container 21** is not less dense as compared with the case where the magnetic particles only stagnate therein, and therefore, the toner particles are not taken into the magnetic powder too extremely. If the toner is taken thereinto too much, the toner is insufficiently charged, resulting in production of foggy background.

This structure is particularly effective when the developer container contains the magnetic particles and non-magnetic toner or weakly magnetic toner, and therefore, it is particularly effective when used with the developing apparatus which has been described hereinbefore. However it is usable with conventional developing apparatus such as those described in Japanese Laid-Open Patent Application No. 93841/1978.

A developing apparatus was constructed according to this embodiment, as shown in FIG. 1. As for the sleeve 22, an aluminum sleeve having the diameter of 20 mm was used after the surface thereof is treated by irregular sand-blasting with ALUNDUM abrasive. Within the sleeve 22, the magnet 23 magnetized with four poles was used, the N and S poles being arranged alternately along the circumference as shown in FIG. 1. The maximum surface magnetic flux density by the magnet 23 was approximately 900 Gauss.

The blade 24 used had the thickness of 1.2 mm made of non-magnetic stainless steel. The angle $\theta$ was set at 15 degrees.

As for the magnetic particles, ferrite particles (maximum magnetization of 60 emu/g) had the particle size of 70–50 microns (250/300 mesh), whose surface was treated by with silicon resin.

The angle $\phi$ and $\theta_2$ was approximately 120 degrees and 20–30 degrees. The distances L and l was 4–5 mm and 1.5–3 mm, respectively.

As for the non-magnetic toner, blue powder provided by a mixture of 100 parts of styrene/butadiene copolymer resin and 5 parts of copper phthalocyanine pigments, and added by 0.6% of the colloidal silica, was used. The average particle size of the toner particles was 10 microns. Upon operation, approximately 20–30 microns thickness of the toner layer was obtained on the sleeve 22 surface, and above the toner layer, the magnetic particle layer of 100–200 microns thickness was formed. On the surfaces of the magnetic particles, there were toner particles.

At that time, the total weight of the magnetic particles and the toner particles on the sleeve 22 was approximately $2.43\times10^{-2}$ g/cm$^2$.

The weight ratio of the toner particles retained on the magnetic particles and the toner particles retained on the sleeve was approximately 2:1.

The magnetic particles were formed into erect chains at and adjacent the developing position by the magnetic pole **23*b* within the sleeve 22**. The maximum height of the chains was approximately 0.9 mm.

The amount of electric charge was measured by a blow-off method, and the triboelectric charge of the toner particles on the sleeve 22 and the magnetic particles was +10 mC/g.

The developing apparatus was assembled into a commercial copying machine, PC-10 sold by Canon Kabushiki Kaisha, Japan. The clearance between the surface of the photosensitive drum 3 made o organic photoconductor material and the surface of the sleeve 22 was set at 350 microns. They were moved at the same peripheral speed, more particularly 66 mm/sec. The volumetric ratio under those conditions was approximately 10% ($h=350$ microns, $M=2.43\times10^{-2}$ g/cm$^2$, $\rho=5.5$ g/cm$^3$, $C/(T+C)=20.4\%$). The bias voltage source 34 provided an alternating voltage having the frequency of 1600 Hz, wherein an alternating voltage having the peak-to-peak value of 1300 V was superimposed with a DC voltage of −300 V. When this was operated, good blue images were obtained.

The developing operation was performed to obtain a solid image, and then the surface of the sleeve 22 was carefully observed after the developing operation. It was confirmed that almost all of the toner particles on the sleeve and on the magnetic particles were consumed up, and therefore, the developing operation was effected with almost 100% development efficiency.

It was confirmed that the development properties were good enough without foggy background, and the V-D curve was as indicated by the reference X in FIG. 3.

Also, it was confirmed that the magnetic member 31 worked well so that the magnetic particles were allowed to enter the container, while the magnetic particles in the container were effectively prevented from leaking out with good circulation in the container.

Figure 10:
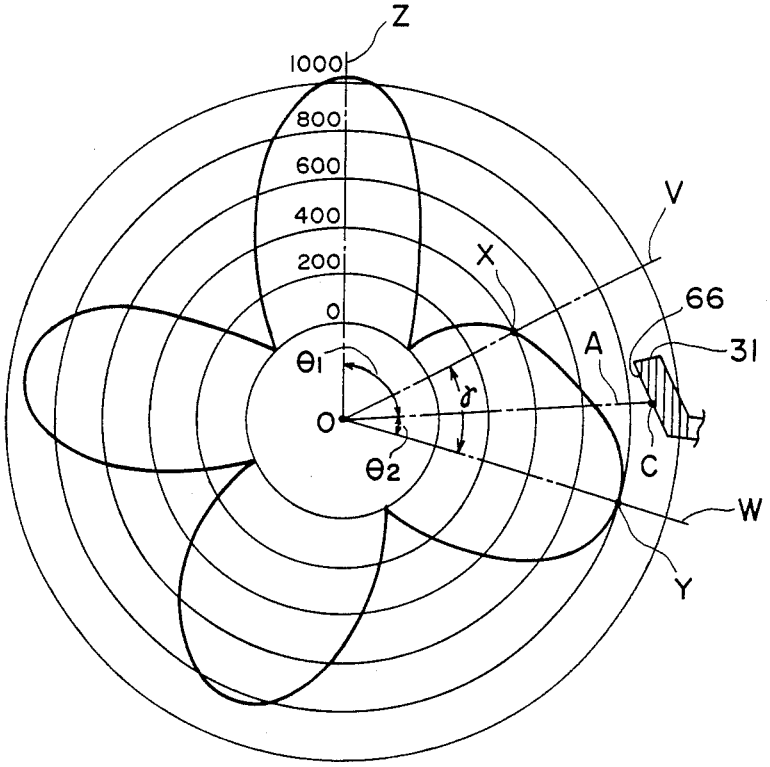
FIG. 10 shows a distribution of magnetic flux densities on the surface of the developer carrying member, which is desirable in the structure shown in FIG. 6.

FIG. 10 illustrates a further preferable magnetic sealing means, wherein the positional relationship between the upstream magnetic pole **23*d* and the magnetic member 31 is most preferable. The structure of the magnetic member 31 of FIG. 10 is similar to that of FIG. 6**, with the exception described below.

Firstly, the surface 66 of the magnetic member 31 is opposed to the surface of the sleeve 22 only in such a region where the upstream (with respect to movement of the sleeve 22) magnetic pole **23*d* forms the magnetic flux density distribution on the surface of the sleeve 22 in connection with the magnetic member 31. An angle $\theta 1$ between the plane Z and the plane A as seen from the center 0 of the sleeve 22 and an angle $\theta 2$ between the plane A and the plane W as seen from the center 0 of the sleeve 22**, satisfy the condition that the angle $\theta 1$ is larger than the angle $\theta 2$. This condition further assures the above described advantages.

The second point relates to the preferable position of the magnetic member 31 in the magnetic flux density distribution on the surface of the sleeve 22 by the upstream magnetic pole **23*d*, independently of the first point. It has been found that it is preferable for the magnetic member 31 to exist in the range of an angle $\gamma$. The angle $\gamma$ is an angle between a line (plane) V and a line (plane) W. The line V is the line between the center 0 of the sleeve and the maximum magnetic flux density point Y (800 Gausses in this embodiment) of the magnetic pole 23*d*, and the line W is the line connecting the center 0 of the sleeve 22 and a point X where the magnetic flux density is the half (400 Gausses in this example) of the maximum at the downstream side of the maximum magnetic flux density point with respect to rotation of the sleeve 22. Thus, the angle $\gamma$ defines the half peak width region of the magnetic flux density at the downstream side from the maximum magnetic flux density position Y. By locating the surface 66 in this region, a further assured seal can be accomplished. The inventors' experiments have shown that when the distance is 2.5 mm, the magnetic carrier particles are completely collected into the developer, while no toner particle leakage is recognized, and therefore, a stabilized development can be carried out. The existence of the surface 66 in this region makes it possible that the magnetic force at the upstream side by the magnetic pole 23*d* is properly diverged or dispersed by the surface 66**, so that the magnetic force in this region can be substantially enhanced, and it is considered that the magnetic sealing effect is increased for this reason.

The minimum distance l from the surface 66 to the surface of the sleeve 22 has been described as being preferably not less than 1.5 mm and not more than 3 mm. This is the preferable condition from the standpoint that the magnetic flux density at the surface of the sleeve is such that the surface 66 of the magnetic member most effectively prevents the developer in the container from leaking out of the container and allows the developer to return thereinto most effectively.

Because of the features described above in any of the foregoing embodiments, more advantageous effects are provided than the structure disclosed in U S. Pat. No. 4,563,978.

As described in the foregoing, according to the embodiments of the present invention, the developing operation is performed with high image density and high development efficiency without the foggy background, the ghost image, the trace of brush and the negative development property, and further without the scattering of the developer.

As for the material of the sleeve 22, it may be aluminum, brass or stainless steel which are electrically conductive. It may be a paper cylinder or a resin cylinder. If the surface of the cylinder is made electrically conductive or it may be electrically conductive, and in that case, it may be used as a developing electrode. The sleeve 22 may be constructed by using a core roll which is wrapped by an electrically conductive elastic member such as a conductive sponge.

As regards the magnetic pole 23*b* at the developing position, it is disposed at the center of the developing station in the direction of the movement of the surfaces of the photosensitive member and the sleeve. However, it may be deviated from the center, or the developing position may be disposed between magnetic poles.

To the toner powder, silica particles may be added to enhance the flowability or abrasive particles or the like may be added to abrade the surface of the photosensitive drum 1 (latent image bearing member) in an image transfer type image forming apparatus. To the toner powder a small amount of magnetic particles may be added. Magnetic toner particles may be used if the magnetic property thereof is very weak as compared with that of the magnetic particles and is triboelectrically chargeable.

In order to prevent the occurrence of the ghost image, the developer layer remaining on the sleeve 22 after the developing action may be once scraped off by scraper means (not shown), and then the scraped sleeve surface is brought into contact to the magnetic particle layer in the container, and then the developer is applied thereon. This is effective to prevent the ghost image.

A mechanism may be added to the developing apparatus, which detect the content of the magnetic particles and the toner particles, and in response to the detection, the toner is automatically supplied.

The developing apparatus according to the present invention is usable with a disposable developing device which contains as a unit the container 21, the sleeve 22 and the blade 24, although it is applicable to the usual developing device which is fixed in an image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image using a developer containing carrier particles and toner particles in a developing position, comprising:

a container for containing developer which contains toner particles and magnetic particles;

a developer carrying member, opposed to a latent image bearing member, for forming the developing position at which the toner particles are supplied to the latent image bearing member and for carrying the developer from said container to the developing position;

magnetic field generating means, disposed across said developer carrying member from its developer carrying surface, and including first and second generating portions, for generating a stationary magnetic field;

means for regulating an amount of the toner particles and carrier particles to be applied on the surface of said developer carrying member; and a magnetic member disposed upstream of said regulating means and downstream of the developing position with respect to the movement direction of said developer carrying member, said magnetic member having a surface spaced from the surface of said developer carrying member to form a clearance which decreases toward a downstream side from an upstream side, wherein a minimum of the clearance occurs downstream of a center of said first generating portion which is closer to said magnetic member with respect to the movement direction of said developer carrying member;

wherein said magnetic member is positioned and arranged relative to said first generating portion to be effective to enhance the magnetic field formed therebetween such that the enhanced magnetic field allows the developer to return to said container after passing through the developing position to enter said developer container while preventing the magnetic particles in said container from leaking out of said container;

wherein the surface of said magnetic member is disposed downstream of said first generating portion with respect to the movement direction of said developer carrying member; and wherein the surface of said magnetic member is flat, and an angle formed from the flat surface to a plane connecting a center of the magnetic field generated by said first generating portion and a middle of the length of the flat surface measured substantially along the movement direction of the developer carrying member, is more than 90 degrees and less than 180 degrees.

2. An apparatus according to claim 1, wherein the surface of said magnetic member is partly opposed to said first generating portion.

3. A developing apparatus for developing a latent image using a developer containing carrier particles and toner particles in a developing position, comprising:

a container for containing developer which contains toner particles and magnetic particles;

a developer carrying member, opposed to a latent image bearing member, for forming the developing position at which the toner particles are supplied to the latent image bearing member and for carrying the developer from said container to the developing position;

magnetic field generating means, disposed across said developer carrying member from its developer carrying surface, and including first and second generating portions, for generating a stationary magnetic field;

means for regulating an amount of the toner particles and carrier particles to be applied on the surface of said developer carrying member; and a magnetic member disposed upstream of said regulating means and downstream of the developing position with respect to the movement direction of said developer carrying member, said magnetic member having a surface spaced from the surface of said developer carrying member to form a clearance which decreases toward a downstream side from an upstream side, wherein a minimum of the clearance occurs downstream of a center of said first generating portion which is closer to said magnetic member with respect to the movement direction of said developer carrying member;

wherein said magnetic member is positioned and arranged relative to said first generating portion to be effective to enhance the magnetic field formed therebetween such that the enhanced magnetic field allows the developer to return to said container after passing through the developing position to enter said developer container while preventing the magnetic particles in said container from leaking out of said container;

wherein the surface of said magnetic member is disposed downstream of said first generating portion with respect to the movement direction of said developer carrying member; and wherein an angle formed between a plane connecting a rotational axis of said developer carrying member and a middle of said magnetic member in a direction of movement of said developer carrying member and a plane connecting the rotational axis and a center of the magnetic field formed by said magnetic field generating means, is more than 20 degrees and less than 30 degrees.

4. An apparatus according to claim 3, wherein the surface of said magnetic member is flat, and an angle formed from the flat surface to a plane connecting a center of the magnetic field generated by said first generating portion and a middle of a length of the flat surface measured substantially along a direction of the movement of the developer carrying member, is more than 90 degrees and less than 180 degrees.

5. An apparatus according to claim 1, wherein the surface of said magnetic member is of a magnetizable material not permanently magnetized.

6. An apparatus according to claim 1, wherein the minimum of the clearance is not less than 1.5 mm and not more than 3 mm.

7. An apparatus according to claim 1 or 3, wherein the surface of said magnetic member has a length measured along the movement direction of said developer carrying member which is not less than 1.5 mm and not more than 6 mm.

8. An apparatus according to claim 7, wherein the length is not less than 2 mm and not more than 5 mm.

9. An apparatus according to claim 1 or 3, wherein the minimum of the clearance is not less than 1.5 mm and not more than 3 mm.

10. An apparatus according to claim 9, wherein a maximum of the clearance is not less than 4 mm and not more than 5 mm.

11. An apparatus according to claim 9, wherein the surface of said magnetic member has a length measured along the movement direction of said developer carrying member which is not less than 1.5 mm and not more than 6 mm.

12. An apparatus according to claim 1 or 3, wherein said second generating portion forms a magnetic field in which at least a part of said regulating means is located, and wherein said second generating portion is disposed across said developer carrying member from the surface thereof carrying the developer.

13. An apparatus according to claim 12, wherein said first generating portion has a magnetic pole having a polarity different from that of said second generating portion, and wherein the surface portion of said magnetic member is a magnet having a magnetic pole with a polarity different from that of said first generating portion.

14. An apparatus according to claim 1 or 3, wherein the surface of said magnetic member is flat, and an edge thereof forms the position where the clearance is minimum, wherein the minimum clearance is not less than 1.5 mm and not more than 3 mm, and wherein said magnetic member is not permanently magnetized.

15. A developing apparatus for developing a latent image using a developer containing carrier particles and toner particles in a developing position, comprising:

a container for containing developer which contains toner particles and magnetic particles;

a developer carrying member, opposed to a latent image bearing member, for forming the developing position at which the toner particles are supplied to the latent image bearing member and for carrying the developer from said container to the developing position;

magnetic field generating means, disposed across said developer carrying member from its developer carrying surface, and including first and second generating portion for generating a stationary magnetic field;

means for regulating an amount of the toner particles and carrier particles to be applied on the surface of said developer carrying member;

a magnetic member disposed upstream of said regulating means and downstream of the developing position with respect to the movement direction of said developer carrying member, said magnetic member having a surface spaced from the surface of said developer carrying member to form a clearance which decreases toward a downstream side from an upstream side and the minimum of which is downstream of said first generating portion which is nearer to said magnetic member, wherein the surface of said magnetic member is effective to form a diverging magnetic field extending from one of said magnetic member and said magnetic field generating means to the other, wherein said magnetic member is cooperable with said first generating portion to form a relatively strong magnetic field at its downstream side and a relatively weak magnetic field at its upstream side with respect to the movement direction of said developer carrying member;

wherein the diverging magnetic field allows the developer to return to said container after passing through the developing position to enter said developer container while preventing the developer in said container from leaking out of said container;

wherein the minimum of the clearance is not less than 1.5 mm and not more than 3 mm;

wherein said first generating portion provides a point Y where a magnetic flux density on a developer carrying surface of said developer carrying member is maximum and a point X where the magnetic flux density is one half of the maximum magnetic flux density at a downstream side of the maximum point Y with respect to the movement direction of said developer carrying member; and wherein the surface of said magnetic member is located within an angle formed between the maximum point Y and the one half point X as seen from a rotational axis of said developer carrying member.

16. An apparatus according to claim 15, wherein the surface of said magnetic member has a length measured along the movement direction of said developer carrying member which is not less than 1.5 mm and not more than 6 mm.

17. An apparatus according to claim 16, wherein the length is not less than 2 mm and not more than 5 mm.

18. An apparatus according to claim 17, wherein a maximum of the clearance is not less than 4 mm and not more than 5 mm.

19. An apparatus according to claim 15, wherein the surface of said magnetic member is flat, and an angle formed between a plane connecting a rotational axis of said developer carrying member and a middle of said magnetic member in a direction of movement of said developer carrying member and a plane connecting the rotational axis and a center of the magnetic field formed by said first generating portion means, is more than 20 degrees and less than 30 degrees.

20. An apparatus according to claim 15, wherein said second generating portion forms a magnetic field in which at least a part of said regulating means is located, said second generating portion is disposed across said developer carrying member from a surface thereof carrying the developer, wherein a plane connecting the rotational axis of said developer carrying member and a center of a magnetic force provided by said second generating portion and a plane connecting the rotational axis and a center of said magnetic member form an angle which is larger than an angle formed between a plane connecting the rotational axis and the maximum point Y and said plane connecting the rotational axis and the center of the magnetic member.

21. An apparatus according to claim 15, wherein the surface of said magnetic member is flat.

22. An apparatus according to claim 15, wherein said magnetic member is not permanently magnetized.

23. An apparatus according to claim 15, wherein said magnetic member is not permanently magnetized.

24. A developing apparatus for developing a latent image using a developer containing carrier particles and toner particles in a developing position, comprising:

a container for containing developer which contains toner particles and magnetic particles;

a developer carrying member, opposed to a latent image bearing member, for forming the developing position at which the toner particles are supplied to the latent image bearing member and for carrying the developer from said container to the developing position;

magnetic field generating means, disposed across said developer carrying member from its developer carrying surface, and including first and second generating portions, for generating a stationary magnetic field;

means for regulating an amount of the toner particles and carrier particles to be applied on the surface of said developer carrying member, wherein said regulating means is positioned and arranged to regulate the developer so as to provide a volumetric ratio of the magnetic particles of not less than 1.5% and not more than 30% at the developing position; and a magnetic member disposed upstream of said regulating means and downstream of the developing position with respect to the movement direction of said developer carrying member, said magnetic member having a flat surface spaced from the surface of said developer carrying member to form a clearance which decreases toward a downstream side from an upstream side, wherein a minimum of the clearance occurs downstream of a center of said first generating portion which is closer to said magnetic member with respect to movement direction of said developer carrying member, wherein said magnetic member is not permanently magnetized and is positioned and arranged relative to said first generating portion to be effective to enhance the magnetic field formed therebetween such that the enhanced magnetic field allows the developer to return to said container after passing through the developing position to enter said developer container while preventing the magnetic particles in said container from leaking out of said container;

wherein the minimum of the clearance is not less than 1.5 mm and not more than 3 mm; and wherein said first generating portion provides a point Y where a magnetic flux density on the developer carrying surface of said developer carrying member is maximum and a point X where the magnetic flux density is one half of the maximum magnetic flux density at a downstream side of the maximum point Y with respect to the movement direction of said developer carrying member, wherein the surface of said magnetic member is located within an angle formed between the maximum point Y and the one half point X as seen from a rotational axis of said developer carrying member.

25. An apparatus according to claim 24 wherein said magnetic member is effective to form a weaker magnetic field than the strong magnetic field at a position downstream of the strong magnetic field generating position.

26. A developing apparatus for developing a latent image using a developer containing carrier particles and toner particles in a developing position, comprising:

a container for containing developer which contains toner particles and magnetic particles;

a developer carrying member, opposed to a latent image bearing member, for forming the developing position at which the toner particles are supplied to the latent image bearing member and for carrying the developer from said container to the developing position;

magnetic field generating means, disposed across said developer carrying member from its developer carrying surface, and including first and second generating portions, for generating a stationary magnetic field;

means for regulating an amount of the toner particles and carrier particles to be applied on the surface of said developer carrying member; and a magnetic member disposed upstream of said regulating means and downstream of the developing position with respect to the movement direction of said developer carrying member, said magnetic member having a flat surface spaced from the surface of said developer carrying member to form a clearance which decreases toward a downstream side from an upstream side, wherein a minimum of the clearance occurs downstream of a center of said first generating portion which is closer to said magnetic member with respect to the movement direction of said developer carrying member;

wherein an angle formed from the flat surface to a plane connecting a center of the magnetic field generated by said first generating portion and a middle of a length of the flat surface measured substantially along a direction of the movement of the developer carrying member, is more than 90 degrees and less than 180 degrees, and wherein the magnetic field formed between said first generating portion and said magnetic member allows the developer to return to said container after passing through the developing position to enter said developer container while preventing the developer in said container from leaking out of said container.

27. A developing apparatus for developing a latent image using a developer containing carrier particles and toner particles in a developing position, comprising:

a container for containing developer which contains toner particles and magnetic particles;

a developer carrying member, opposed to a latent image bearing member, for forming the developing position at which the toner particles are supplied to the latent image bearing member and for carrying the developer from said container to the developing position;

magnetic field generating means, disposed across said developer carrying member from its developer carrying surface, and including first and second generating portions, for generating a stationary magnetic field;

means for regulating an amount of the toner particles and carrier particles to be applied on the surface of said developer carrying member; and a magnetic member disposed upstream of said regulating means and downstream of the developing position with respect to the movement direction of said developer carrying member, said magnetic member having a surface spaced from the surface of said developer carrying member to form a clearance which decreases toward a downstream side from an upstream side, wherein a minimum of the clearance occurs downstream of a center of said first generating portion which is closer to said magnetic member with respect to the movement direction of said developer carrying member;

wherein an angle formed between a plane connecting a rotational axis of said developer carrying member and a middle of said magnetic member in a direction of movement of said developer carrying member and a plane connecting the rotational axis and a center of magnetic field formed by said first generating portion, is more than 20 degrees and less than 30 degrees, and wherein the magnetic field formed between said first generating portion and said magnetic member allows the developer to return to said container after passing through the developing position to enter said developer container while preventing the developer in said container from leaking out of said container.

28. A developing apparatus for developing a latent image using a developer containing carrier particles and toner particles in a developing position, comprising:

a container for containing developer which contains toner particles and magnetic particles;

a developer carrying member, opposed to a latent image bearing member, for forming the developing position at which the toner particles are supplied to the latent image bearing member and for carrying the developer from said container to the developing position;

magnetic field generating means, disposed across said developer carrying member from its developer carrying surface, and including first and second generating portions, for generating a stationary magnetic field;

means for regulating an amount of the toner particles and carrier particles to be applied on the surface of said developer carrying member; and a magnetic member disposed upstream of said regulating means and downstream of the developing position with respect to the movement direction of said developer carrying member, said magnetic member having a surface spaced from the surface of said developer carrying member to form a clearance which decreases toward a downstream side from an upstream side, wherein a minimum of the clearance occurs downstream of a center of said first generating portion which is closer to said magnetic member with respect to movement direction of said developer carrying member;

wherein said first generating portion provides a point Y where a magnetic flux density on the developer carrying surface of said developer carrying member is maximum and a point X where the magnetic flux density is one half of the maximum magnetic flux density at a downstream side of the maximum point Y with respect to the movement direction of said developer carrying member, wherein the surface of said magnetic member is located within an angle formed between the maximum point Y and the one half point X as seen from a rotational axis of said developer carrying member, and wherein the magnetic field formed between said first generating portion and said magnetic member allows the developer to return to said container after passing through the developing position to enter said developer container while preventing the developer in said container from leaking out of said container.

29. An apparatus according to any one of claims 1, 3, 15, 24, 26, 27, or 28, further comprising means for forming an alternating electric field at the developing position.

* * * * *

UNITED STATES PATENT AND TRADEMARK OFFICE

CERTIFICATE OF CORRECTION

PATENT NO. : 4,838,200

DATED : June 13, 1989

INVENTOR(S) : ATSUSHI HOSOI, ET AL.

It is certified that error appears in the above-identified patent and that said Letters Patent is hereby corrected as shown below:

ON THE TITLE PAGE,
IN [57] ABSTRACT

Line 6, "surface a" should read --surface; a--.
Line 14, "and being from an upstream side" should read --from an upstream side and being--.

COLUMN 1

Line 8, after "more paticularly" insert --a--.
Line 9, after particles, insert --is used.--.
Line 19, "position," should read --position),--.
Line 60, "the recover" should read --recover--.
Line 61, "tensionally" should read --tentionally--.

COLUMN 2

Line 7, "employed and." should read --employed.--.
Line 22, "returns" should read --to return--.
Line 34, "magnetic sealing mean" should read --magnetic sealing means--.

COLUMN 4

Line 45, "parmanent magnet" should read --permanent magnet--.

COLUMN 5

Line 45, "b" should read --by--.

UNITED STATES PATENT AND TRADEMARK OFFICE

CERTIFICATE OF CORRECTION

PATENT NO. : 4,838,200

DATED : June 13, 1989

INVENTOR(S) : ATSUSHI HOSOI, ET AL.

It is certified that error appears in the above-identified patent and that said Letters Patent is hereby corrected as shown below:

COLUMN 6

Line 33, "the pass" should read --they pass--.
Line 41, "those" should read --the--.

COLUMN 8

Line 6, "easy" should read --easily--.
Line 39, "mad" should read --made--.
Line 57, "and or" should read --or--.

COLUMN 9

Line 53, "are" should read --is--.

COLUMN 10

Line 5, "ρis" should read --ρ is--.

COLUMN 12

Line 19, "g out" should read --go out--.
Line 28, "o" should read --of--.

COLUMN 13

Line 37, "ar" should read --are--.
Line 40, "amount the magnetic particles" should read --the amount of magnetic particles--.

UNITED STATES PATENT AND TRADEMARK OFFICE

CERTIFICATE OF CORRECTION

PATENT NO. : 4,838,200

DATED : June 13, 1989

INVENTOR(S) : ATSUSHI HOSOI, ET AL.

It is certified that error appears in the above-identified patent and that said Letters Patent is hereby corrected as shown below:

COLUMN 13

Line 59, "is attracted" should read --are attracted--.
Line 62, "is" should read --are--.
Line 65, "is" should read --are--.
Line 66, "it is" should read --they are--.

COLUMN 14

Line 1, "is" should read --are--.
Line 52, "shaped "L"" should read --"L"-shaped--.

COLUMN 15

Line 32, "is" should read --are--.

COLUMN 16

Line 5, "the return" should read --to return--.
Line 68, "by" should be deleted.

COLUMN 17

Line 1, "was" should read --were--.
Line 2, "was" should read --were--.
Line 32, "made o" should read --made of--.

COLUMN 19

Line 27, "detect" should read --detects--.

UNITED STATES PATENT AND TRADEMARK OFFICE

CERTIFICATE OF CORRECTION

PATENT NO. : 4,838,200

DATED : June 13, 1989

INVENTOR(S) : ATSUSHI HOSOI, ET AL.

It is certified that error appears in the above-identified patent and that said Letters Patent is hereby corrected as shown below:

COLUMN 21

Line 23, "claim 1," should read --claim 12,--.
Line 26, "claim 1," should read --claim 5,--.

COLUMN 22

Line 12, "generating portion" should read --generating portions--.

Signed and Sealed this

Twenty-ninth Day of October, 1991

*Attest:*

HARRY F. MANBECK, JR.

*Attesting Officer*

*Commissioner of Patents and Trademarks*